United States Patent [19]

Weber

[11] 4,385,575

[45] May 31, 1983

[54] EASY-THREADING SEWING NEEDLES AND METHOD OF MAKING SUCH NEEDLES

[76] Inventor: Richard D. Weber, 1647 Wood Duck Dr., Wheeling, Ill. 60090

[21] Appl. No.: 167,098

[22] Filed: Jul. 8, 1980

[51] Int. Cl.[3] ..... D05B 85/02

[52] U.S. Cl. ..... 112/224; 223/102

[58] Field of Search ..... 112/224, 222, 223, 225, 112/226, 227; 223/102

[56] References Cited

U.S. PATENT DOCUMENTS

| | | | |
|---|---|---|---|
| 1,054,117 | 2/1913 | Henderson | 112/224 |
| 1,878,915 | 9/1932 | Trejo | 112/224 |
| 2,721,014 | 10/1955 | Allen | 223/102 |

FOREIGN PATENT DOCUMENTS

| | | | |
|---|---|---|---|
| 503945 | 12/1954 | Italy | 112/224 |
| 16119 | of 1902 | United Kingdom | 112/224 |

*Primary Examiner*—Peter P. Nerbun
*Attorney, Agent, or Firm*—Richard G. Kinney

[57] ABSTRACT

Easy-threading sewing needles, in two embodiments, for hand needles and sewing machine needles are disclosed, as well as a method for making the easy-threading structure. The needles have eyes defined by sidewalls, one of which is slit along a plane which passes from the outer surface into the eye and divides the sidewall into an elongated inner clip member and a conforming retaining member. The clip member is mechanically spring-biased against the retainer but may be resiliently bent inward to open the slit by pressing a thread loop against the outside of the sidewall. The clip springs back against the mating surface of the retainer as soon as the thread enters the eye and the pressure is removed. The machine needle includes an off-center eye and the thread trap formed on the thinner sidewall, the point of the needle being formed off-center under the eye and a smooth shoulder projecting outward just under the entrance to the slit. In making the thread trap, maleable needle stock is slit prior to tempering and the clip and retainer members reversed in position by moving the clip outward. The clip is hardened and tempered to make it resilient in this outward position and then resiliently bent into its original position within and now bearing against the retainer member.

2 Claims, 12 Drawing Figures

EASY-THREADING SEWING NEEDLES AND METHOD OF MAKING SUCH NEEDLES

FIELD OF THE INVENTION

The present invention is directed to an improvement in machine or hand sewing needles and is especially concerned with a new and improved easy-threading needle and the method of making the needle.

BACKGROUND OF THE INVENTION

Hand needles pre-date the written history of mankind. Bone needles broadly similar in appearance to those still in use today have been found by archaeologists among the remains of early man. The advent of metal technology resulted in greatly improved needles and the invention by Howe of the sewing machine, which uses a special needle with an eye near the point, is considered revolutionary, not only in sewing but in society. Some historians have credited it with lowering the cost of clothing so that the working man could afford a stylish suit. No longer could the rich man or the workingman necessarily be told by the "cut of his cloth."

In use, sewing needles, whether for sewing machines or hand, have suffered from one annoying drawback: the problem of threading the needle. The Bible alludes to the problem (Luke 18:25). The elderly, those with bad eyesight, or shaky hands, find it nearly impossible. In industrial applications, considerable time of garment workers, seamstresses, tailors, etc. is wasted in the difficult threading operation.

Others have attempted to make easy-threading needles in the past. See, for example, U.S. Pat. Nos. 3,031,116; 3,473,710; 3,525,460; and 3,531,030, But these have met with little or no success in the marketplace. These proposed solutions have generally suffered from the fact that they allow the needle to become unthreaded, or else that they include sharp projections which snag the cloth or other material in which the needle is used, or that they are too complex, difficult and expensive to make, or that they are nearly as difficult to thread as the ordinary needle.

SUMMARY OF THE INVENTION

In overcoming the drawbacks of prior easy-threading needles, a needle constructed in accordance with the present invention provides a needle with an eye having a sidewall to the eye formed of a clip bar which is mechanically biased outward and bears against a conformingly shaped retainer, both formed unitarily with the needle, and both clip bar and retainer being formed with smooth flowing outer and inner surfaces and without any ensnaring projections out from the surface of the needle or into the eye interior. The needle is preferably used for sewing machines and has an eye positioned off-center to provide a thinner wall in which the slit is made with the point aligned under the eye.

In use, a loop of thread may be pressed against the clip, causing it to open to allow the thread to easily pass into the eye. After the thread enters the eye, the clip bar springs back against the retainer to close the side opening into the eye and prevent the thread from leaving the eye thereby.

GENERAL DESCRIPTION AND ADVANTAGES OF THE INVENTION

Hand sewing needles and sewing machine needles constructed in accordance with the present invention may be advantageously used by garment workers, seamstresses, tailors, upholsterers, and every person having sewing skills to make sewing by hand or machine an easier task.

The present invention permits the sewer to easily thread the needle for use without the necessity of sighting an end of thread directly into and through the eye. This ease of threading the needle is accomplished by means of a unique side-loading design, adaptable to and constructed into sewing needles and sewing machine needles.

The construction is simple in structural form, maintains needle strength and practicality. The construction may be accomplished by a double rod construction process in which the clip member or bar is fabricated as an external overlapping part to the retainer, and then drawn to the inside wall of the clip bar retainer which is formed after the eye has been struck with a cutting die and tempered to spring metal hardness, thus making the clip bar an integral part of the wall to one side of the eye.

However, when single rod construction is preferred, a cutting die can be used to cut the thread-trap designed eye into the single rod constructed needle. Single rod construction may be employed when the steel is soft and the eye is stamped through the needle body. The clip bar is then withdrawn to outside the clip bar retainer, ground smooth, and hardened and tempered in this position. After tempering, the clip bar is drawn back to inside the clip bar retainer, to its operational position. The outward pressure of the clip bar on the clip bar retainer is maintained by spring metal temper.

The present needle is superior to others of its type because of the trapping action of the unique clip member or bar and clip retainer member which is formed in the needle during the construction process. It is designed to retain much or all of the strength lost by a needle containing any open slits, slots, or gaps, and to strengthen major stress points present in the sewing machine needle.

The unique clip bar feature is made without any sharp spurs, tongues, legs or protruding parts which would increase the size of the needle body or eye portion, as this would greatly restrict the use of the needle, inasmuch as such spurs would prevent backing up the needle in the opposite direction, leave large holes in the material, and restrict the sewing of small areas, such as buttons. The present needle can perform in all of these areas without restrictions. The needle of the present invention is constructed in such a way that there is no need to decrease the diameter of the needle body to prevent snagging, thereby weakening the structure. The two parts of a thread trap fit together and are ground smooth.

Needles of the present invention, like conventional needles, will only vary in size in accordance with the size of the needle or its particular use and to accommodate the size of thread intended for that use.

The present invention provides a hand sewing needle which is simple to make and use and has definite advantages in its easy-threading thread trap feature. Besides its quality of being easily and quickly threaded, it has another feature which eases and speeds the sewer's work. After the needle is passed through the material and the thread is being drawn through, the placement and pull of thread on the needle is at the top end of the eye, opposite the point, thus creating an area of stress. The present needle is designed in such a way, with its clip bar and clip bar retainer, that strength is retained in this specific stress point. The clip bar with its outward pressure forms a completed wall of the eye, and, because it has no open slits, slots, or gaps, retains the strength that would otherwise be lost.

The location of the opening into the eye of the slit between the two members is another important factor in the strength of the tool. Located at the bottom portion of the eye, or point end, opposite the stress point, it still affords the accessibility required but does not weaken the stress point.

Both of these factors combined create a stronger sewing tool which will allow the user to easily thread a double or redoubled length of thread through the easy-threading feature of the present invention into the needle eye, a task which cannot be easily accomplished with a conventional needle. By slipping a double or redoubled length of thread into our thread-trapping eye, a person can speed his smaller job, such as buttons, and quickly and easily reinforce seams, zippers, etc. with a doubled or redoubled length of thread which will be sewn with once and will not require a second pass.

When applied to sewing machine needles, the present invention has far more to offer than an easy-threading side loading feature. Impact, resistance and speed of sewing machine action create stress which must be tolerated by the sewing machine needle. Stress is greatly increased in the area surrounding a hole through the needle shaft, this being the area forming the walls of the eye in the needle. Reducing the thickness in the walls of the eye to permit a large opening necessary to sight a single thread through, greatly reduces strength in the structure. Therefore, to increase strength in the area surrounding the eye, a conventional design solution would be to construct a smaller eye which would be more difficult to thread. Since this solution would not be practical and the stress problem was solved with stronger materials, needle design has remained unchanged. With the benefit of stronger materials and the present invention, we have eliminated the necessity for a large eye to sight a single thread through, and increased strength in the walls of a smaller eye which permits easy threading through the present improved design.

It may well be that one day all sewing needles will be constructed with this easy-threading feature.

The invention, together with the advantages thereof, may best be understood by reference to the following description taken in connection with the accompanying figures of which like reference numerals identify like elements.

DETAILED DESCRIPTION

Figure 1:
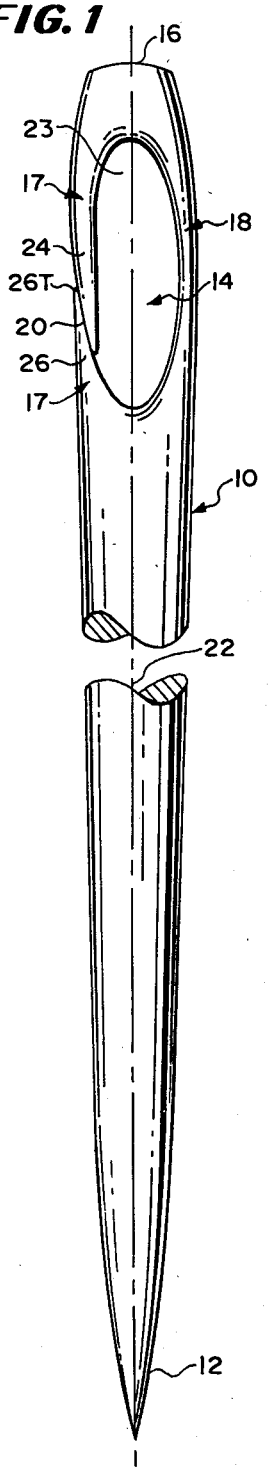
FIG. 1 is a side-elevational view of a hand sewing needle constructed in accordance with the present invention.

Referring now to FIG. 1, there is depicted a needle which is constructed in accordance with the present invention and is generally designated by the number 10. The needle 10 is a hand sewing needle with a conical point 12 at one end and an eye 14 formed at the other truncated end 16.

The needle 10 eye 14 has two sidewalls 17 and 18, one of which is, in accordance with the present invention, cut or slit, along the line 20, in a plane which is oriented at an oblique angle to the central axis (indicated by 22) of the needle 10. The slit 20 is formed by a cutting die so as to remove little or no metal, as will be explained hereafter.

The slit 20 forms the sidewall 17 into two portions: a clip extension or bar 24 and a retaining extension or retainer 26. The surface of the slit 20 is preferably slightly curving to be slightly concave on member 26 and convex on member 24. In accordance with a feature of the present invention, the clip 24 is spring-biased to bear against the retainer 26. It may be noted here that this is not accomplished by leaving out material from either wall of the eye. Such a procedure would weaken or remove a part of the structure, leaving an open space or gap. Nor can any conventionally manufactured sewing needle or machine needle be easily retrofitted, altered or modified to this construction, as the tight mating between the clip 24 and retainer members 24, 26 and spring bias may not be easily accomplished in such original needles.

As hand sewing needles are drawn through fabric or the like in only one direction (unlike sewing machine needles), it is a desirable feature of the present invention that the retainer 26 presents a smooth surface to its tip 26T which fits tightly against the smooth outer surface of the member 26. In this way, no outstanding "brake" in the outer surface is present to snag any fabric.

The inner surface of the member 24 and especially its tip 24T is of the same or preferably smaller width than the contacting portion of the inner surface of the member 26, so that no outstanding surface is presented out of the eye 14, to snag fabric.

Figure 2:
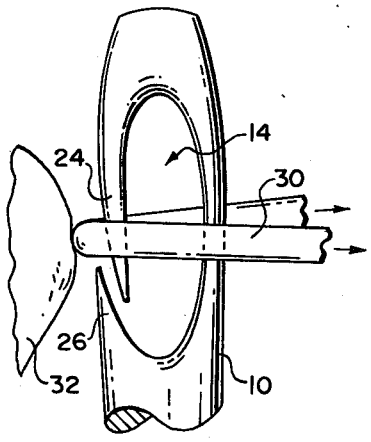
FIGS. 2, 3 and 4 are partial side elevational views of the needle of FIG. 1 in stages of being threaded and illustrating the operation of the easy-threading feature of the present invention.
Figure 3:
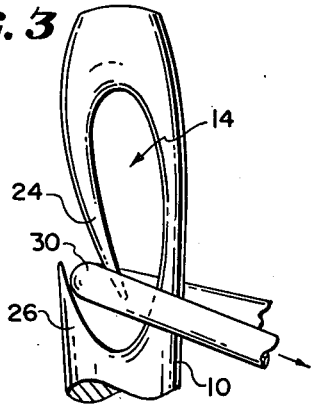
Figure 4:
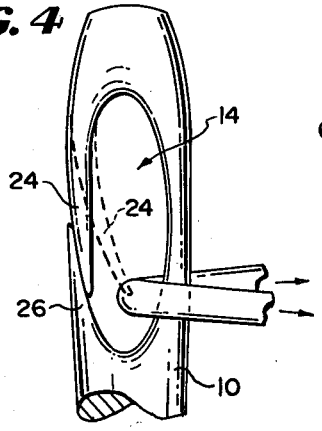

In use, a needle constructed in accordance with the present invention such as the needle 10, can be easily and quickly threaded. With reference to FIG. 2, the needle may be held in a vertical position, point down, and by holding a length of sewing thread 30 between the hands or a finger 32 in a horizontal position against the clip bar as shown in FIG. 2. The thread is then drawn or pulled into the eye of the needle by means of the clip bar yielding to the pressure exerted by the body of thread being inserted, as seen in FIGS. 2 and 3. After the thread is passed through into the eye, the clip bar 24 snaps back to its original position, as shown in FIG. 4, again exerting pressure against the clip bar retainer 26, thus trapping the thread 30 inside the eye 14, preventing accidental or unintentional escape of the thread 30.

In this respect it should be noted that the exit from the slit 20 is (at 24T) positioned at the point end or bottom (as shown in FIG. 1) of the eye 14 and thus normally away from the thread seated in the eye 18 during the active sewing operation. That is, as the needle is drawn and pulls the thread, the thread is seated at the area designated 23 in FIG. 1, away from the slit exit. This, of course, reduces the chance of the thread ever being able to enter the exit of slit 20 near the tip 24T and since force would be needed to open the passageway by bending spring clip member 24, the thread is unlikely to ever exit in this manner.

Figure 5:
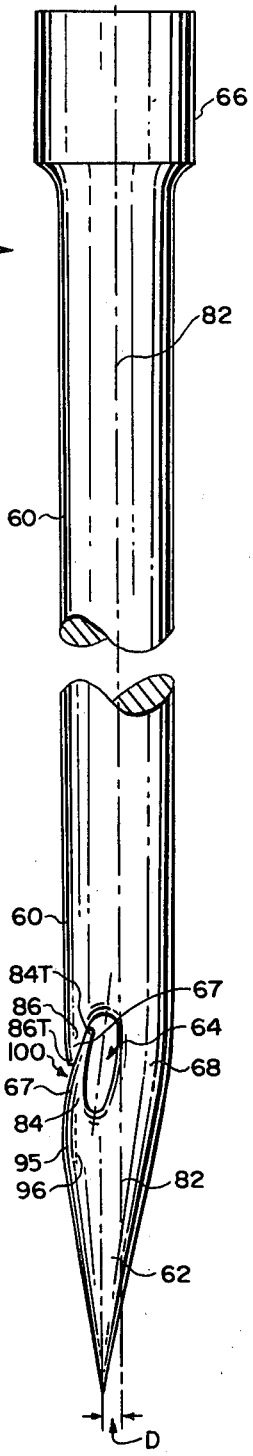
FIG. 5 is a partial perspective view of a sewing machine needle constructed in accordance with the present invention.

Referring now to FIG. 5, there is depicted a sewing machine needle constructed in accordance with the present invention and generally designated 60. The needle 60 has a pointed lower end 62 and a needle bar receiving upper longitudinal end 66. Near the pointed end 62 an eye 64 is defined between a sidewall 68 and an opposed sidewall 67. In this embodiment, the eye 64 is formed off-center from the central axis 82 of the needle 60 so as to have the wall 68 considerably thicker than the wall 67.

Also in accordance with the present invention, the wall 67 is split along a plane oblique to it and to the axis 82 to form a clip member or bar 84 and retainer 86. This clip bar 84 and retainer are tapered as is better shown in FIG. 6, and each smoothed so as to provide no "burrs" or catch points. The clip member 84 is spring biased outward and bears against the retaining member 86. The two members' contacting surfaces conform to one another and mate together. This construction provides mechanical support for the needle.

Thus two members 84 and 86 are, at their outer surfaces ground down to form a trough 100 (FIG. 5) which serves to receive and thus easily position a thread loop across it. The thread loop may thus be pulled into the eye from the trough 100 by simply pulling on the ends of the loop. This causes the clip member 84 to bend into the eye 64 and the thread to roll on it and through the space formed between the clip and retaining member. As soon as the thread enters the eye and clears the tip 84T of the clip member 84, the clip 84 springs back against the retainer 86.

Since the eye 14 and thread trapped in the hand sewing needle are located in the blunt end of the needle, and the eye and thread trap of a sewing machine needle are located at the point end of the needle, it should be noted that the hand sewing needle 10 is preferably threaded with a slight downward motion, and the sewing machine needle 60 is threaded with a slight upward motion.

Note that most of the metal, and thus the strength, of the needle 60 at the eye 64 level is in wall 68 and that the lateral forces on clip 84 by the thread pulling are transferred to the bottom of the needle 60 and are taken up by this thick wall 68.

Now it is normal to provide eyes in conventional needles as large as is practical so as to make it a little easier to thread the needle. With the easy threading feature just described, it is not necessary to provide an eye of as large a size as is normal and usually a smaller eye size will serve. This, plus the off-center positioning of the eye 64 (see FIG. 5) serves to remove less of the metal than the normal eye, thus increasing the strength of the remaining structure. Further, as the retainer and clip are mated together under spring bias, and because of the oblique angle between these two members' mating line, the needle is stronger mechanically than conventional (open gap) easy-threading needles.

Figure 6:
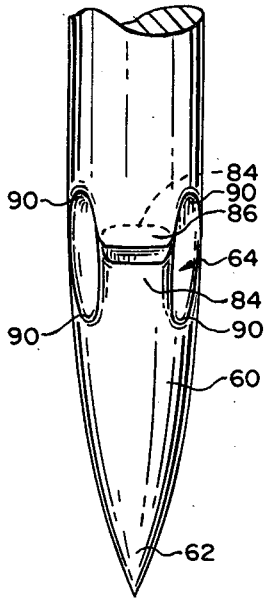
FIG. 6 is a front partial view of the needle of FIG. 5.

Even though the needle 60 is designed for easy-thread side loading, the normal entrances to the eye 64 are flared, as at 90 in FIG. 6, to accommodate normal threading and also to provide for easy movement of the thread through the needle during the sewing operation.

As best shown in FIG. 5, a shoulder 95 is formed below the trough 100. This smooth shoulder 95 projects outward from the normal cylindrical surface of the shaft of the needle, the line of which, for clarity, is continued as dashed line 96 in FIG. 5. The function of this shoulder will be clearer if one considers that the sewing machine needle is driven in a reciprocating motion up and down, stopping at its extreme positions and reaching its maximum velocity at the mid-point of its travel, normally about when the eye area of the needle is passing through the fabric or like substance seing sewn. Thus it can be appreciated that the shoulder 95 on a down stroke will encounter the fabric first and impart to it a lateral or horizontal force which will, for most fabrics, contact and deflect the fabric fibers so encountered horizontally away from the needle 60. While such fibers will normally elastically return, their inertia is sufficient that they will not return until the trough 100 has passed them. Thus, the shoulder 95 serves to prevent any fibers of the fabric from entering the trough 100 on the downstroke of the needle and prevents them from possibly being caught at the tip 86T of the retainer 86.

On the up-stroke, the smooth outer surface of the longer clip member 84 serves to smoothly deflect any fabric.

It should also be noted from FIG. 5, that the point 62 is not aligned centrally but is displaced from the central axis by a distance "D" which is equal to the displacement of the center of the eye 64 from the axis 82. That is, the point 62 is vertically aligned with the eye 64. This serves to reduce the lateral stress on the thread during the sewing operation.

Also it should be noted that the elongated eye 64 has an elongated central axis shown in FIG. 5 and designated 64A which is offset slightly to the vertical, preferably, as shown, by about 6 degrees. This slight offset tends to divert the force applied by the thread to the needle eye in the downward plunge, back toward the center axis of the needle and to reduce any flexing or vibration that might result from the off-center eye. On the upward stroke of the needle, the thread applies force to the bottom of the eye 64 at a slight outward angle, which would tend to pivot the end 62 about the wall 68. However, the spring nature of the metal of wall 68 and the mechanical spring bias imparted to the member 84, in a manner to be explained below, serves to easily accommodate this and to a certain degree the spring of member 84 serves as a shock absorber to smooth out and dampen any vibrations or movement of the point 62 and of the needle 60.

Figure 7:
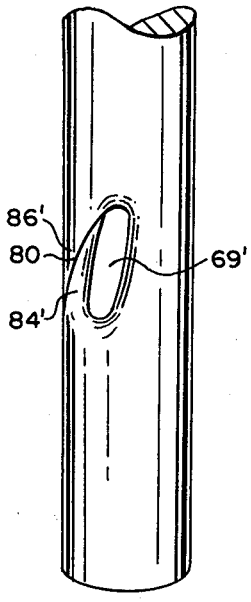
FIGS. 7, 8, 9 and 10 are perspective views of successive steps in making an easy-threading needle in accordance with the present invention.

Referring to FIGS. 7–12, the general method of making the eye portion in accordance with the invention is there illustrated by detailing one specific way of making the needle 60 of FIGS. 1–6. In this case, the needle is made from needle soft steel bar stock 60S and as the first stage of making the needle eye 64 and thread trap formed by members 84 and 86 is shown in FIG. 7.

That is, a small hole 64' is stamped out and a slit 80 is cut preferably by conforming dies stamping through the stock 60S. As mentioned before, this can be done in one or two operations and the result is shown in FIG. 7 with a proto-clip 84' and proto-retainer 86' formed by the slit 80.

Figure 8:
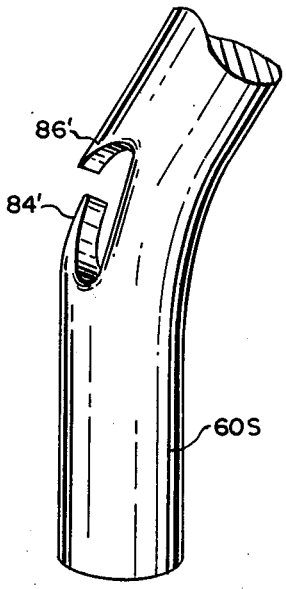
Figure 9:
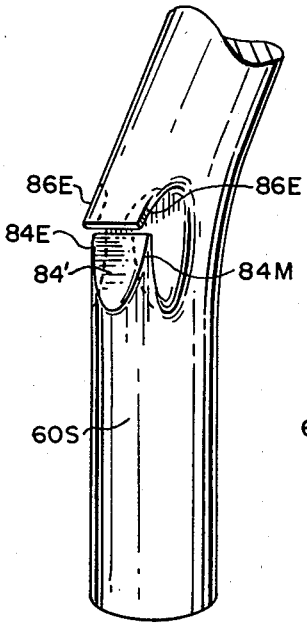

The next step is shown in FIGS. 8 and 9 wherein the stock is bent to separate the proto-members 84' and 86' for ease of working on them. These members are ground smooth and the marginal edges 84E, 84M, 86E and 86M of them removed to the dotted lines and, preferably, the flaring 90 of the opening made.

Figure 10:
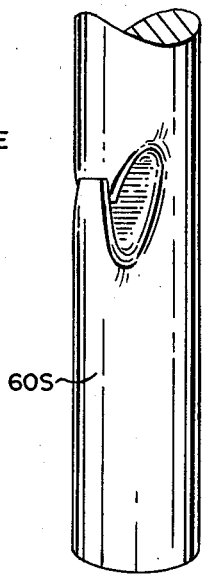
Figure 11:
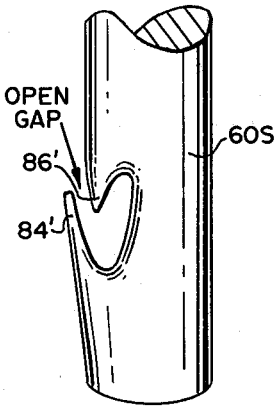
FIG. 11 is a side-elevational view of the needle block of FIG. 7.
Figure 12:
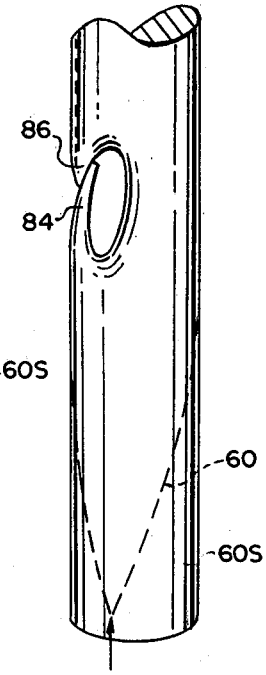
FIG. 12 is a further stage of construction of the needle.

Thereafter the clip 84' is bent outward to overlay the retainer 86', and the top of the stock 60S rebent to assume its vertical position as shown in FIG. 10. As shown in FIG. 11, the clip 84' is spaced from the retainer 86' by an open gap. Because the stock 60S is relatively maleable at this stage, it retains the shape shown in FIGS. 10 and 11. The next step is to heat treat, harden and temper the stock in the configuration of FIGS. 10 and 11. The rod or stock 60S then has the member 84 inserted in its final position as shown in FIG. 12 and the shaft 68S ground down to be cylindrical about axis 82 (FIG. 5) above the eye and into the point below the eye as shown by the dashed lines in FIG. 12. (This grinding operation may also be performed in the stage shown in FIGS. 10 and 11 prior to hardening, tempering and insertion of the member 84.)

The insertion of the clip 84 is best accomplished, it is believed, by using a thin pry-bar positioned within the eye 64 and between the members 84 and 86 and overlaying the member 84. By pivoting the pry-bar downward about the eye, the member 86 is resiliently compressed and bent outward; the point 62 resiliently bent (about wall 68) and the member 84 compressed and caused to snap into the eye and into place after the thin pry-bar is withdrawn therefrom.

The above-described method employed a single bar 60S but can be easily modified to apply to multi-bar methods of making needles.

The same general method can be applied in making the hand needle 10 of FIGS. 1–4. In this case, of course, the hole or eye is cut and the sidewall slit as generally shown in FIG. 1, prior to hardening and tempering and the member 24 moved outward to overlay but be spaced from the member 26. After trimming and de-burring, the needle as thus arranged is tempered and hardened and the clip member 24 resiliently moved back into the arrangement of FIG. 1. This may best be done by deflecting it to the side, not unlike the manner of inserting a safety pin into its seat, if the thickness of the member 24 permits. Otherwise, the above method may be employed. This construction, of course, guarantees that the clip 24 will bear against retainer 26 with spring pressure.

While two particular embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention.

I claim:

1. An improved, easy-threading needle, comprising an elongated member having an outer surface and a point defined at one longitudinal end, and an eye defined by a pair of sidewalls formed in said member, said eye being defined intermediate said pointed end and the other longitudinal end of the needle, one of said sidewalls being slit along a plane generally oriented at an oblique angle to both the outer surface and the central axis at said one sidewall, said slit running from said outer surface through said one sidewall and to said eye so as to divide said sidewall into a clip member and a restraining member, and wherein the clip member is spring-biased to contact said restraining member and close the slit, but wherein said clip member may be resiliently bent inward in response to the pressure of a thread against said clip member at the outer surface of said slit, to open said slit so as to allow the thread to pass through it and into the eye, but to resiliently spring back against said restraining member to close the slit after the thread has entered said eye; and said needle is for use in a sewing machine, said eye is elongated along an axis approximately paralleling the axis of the needle, and has one elongated eye end away from said pointed end, and wherein said clip member extends away from said pointed end and defines said slit to open at said one eye end away from said pointed end; and said clip member and said restraining member are tapered at the outer surface of the wall to form a guiding trough thereat for receiving a thread; and wherein the eye is positioned off-center of the needle so that said one end wall is thinner than the other of the pair of sidewalls and wherein the point of the needle is formed along a line offset from the main axis of the needle and aligned with and under the off-center eye.

2. The invention of claim 1 wherein a smooth outstanding shoulder is formed on the outer surface of the needle member between the needle point and the said slit defined between said clip and restraining members, said shoulder being outstanding from the general surface of the needle and from said trough to deflect pierced cloth from the trough.

* * * * *